US006367490B1

(12) United States Patent
Namba

(10) Patent No.: US 6,367,490 B1
(45) Date of Patent: Apr. 9, 2002

(54) PROCESSING APPARATUS AND PROCESSING METHOD

(75) Inventor: Kazuyoshi Namba, Hachioji (JP)

(73) Assignee: Tokyo Electron Limited, Tokyo-To (JP)

( * ) Notice: Subject to any disclaimer, the term of this patent is extended or adjusted under 35 U.S.C. 154(b) by 0 days.

(21) Appl. No.: 09/431,169

(22) Filed: Nov. 1, 1999

(30) Foreign Application Priority Data

Nov. 2, 1998 (JP) ..... 10-327500

(51) Int. Cl.[7] ..... B08B 3/02

(52) U.S. Cl. ..... 134/95.3; 134/102.1; 134/103.2; 134/902

(58) Field of Search ..... 134/95.3, 102.1, 134/102.2, 103.2, 103.3, 144, 153, 902

(56) References Cited

U.S. PATENT DOCUMENTS 5,651,834 A * 7/1997 Jon et al. ..... 134/902 X
5,887,605 A * 3/1999 Lee et al. ..... 134/902 X

FOREIGN PATENT DOCUMENTS

JP 168446 * 9/1984 ..... 134/902
JP 131026 * 6/1991 ..... 134/902
JP 74752 * 3/1993 ..... 134/902
JP 299400 * 11/1993 ..... 134/902

* cited by examiner

*Primary Examiner*—Philip R. Coe
(74) *Attorney, Agent, or Firm*—Smith, Gambrell & Russell, LLP

(57) ABSTRACT

A processing apparatus is provided for cleaning a wafer W. In the apparatus, a carbonated solution in the form of mist is ejected onto the wafer W through a nozzle 41, so that the film of carbonated solution, i.e., a conductive liquid film is formed on the wafer W. Next, a pure water highly pressurized by a jet pump 47 is ejected on the wafer W for cleaning it. The film of carbonated solution prevents devices built on the wafer W from being broken electrostatically. A liquid passage 52 from a supply source 51 of the carbonated solution up to the nozzle 41 is made of material which does not dissolve its metallic components into the carbonated solution in spite of the contact of the liquid passage 52 with the carbonated solution.

18 Claims, 10 Drawing Sheets

PROCESSING APPARATUS AND PROCESSING METHOD

BACKGROUND OF THE INVENTION

1. Technical Field of the Invention

The present invention relates to a processing apparatus and a processing method for carrying out a designated treatment while supplying a treatment liquid to substrates, such as semiconductor wafers. Particularly, the invention relates to a cleaning technique for the substrates.

2. Description of the Related Art

Generally, in the manufacturing process for semiconductor devices, a cleaning systems is employed in order to remove various contamination adhering to surfaces of the semiconductor wafers, for example, particles, organic contaminants, metal impurities, or the like. On behalf of the cleaning system for cleaning the wafers, there is known a single wafer processing system using a spin type of cleaning apparatus. In the conventional cleaning method, there are also known a scrub cleaning by contact of a rotating member, such as brush or sponge, with a surface of the wafer in rotation, and a jet cleaning by supplying the treatment liquid highly-pressurized by a jet pump to the wafer surface through a jet nozzle.

When employing a pure water of high resistivity in the above jet cleaning, it is indispensable to take a measure to eliminate static electricity from the pure water. If the pure water on the order of 15 to 18 Mω in resistivity is supplied to the wafer surface under high pressure of 50 to 100 $kgf/cm^2$, then the wafer takes an electrical charge. Further, when the electrical charge on the wafer exceeds its dielectric strength, there is a possibility that sparks due to static electricity are produced to destroy semiconductor devices built on the wafer, electrostatically.

Accordingly, in the related art shown in FIG. 12, a bubbling unit 102 having carbon dioxide ($CO_2$) bubbled up therein is arranged in the middle of a transporting passage 101 to transport the treatment liquid to a jet nozzle 100, so that the treatment liquid of a carbonated solution ($H_2CO_3$) is produced by passing the pure water (DIW) through the bubbling unit 102. After being pressurized into high pressure by a jet pump 103, the carbonated solution on the order of 0.2 Mω in resistivity is fed to the jet nozzle 100 and ejected to the surface of a water W. The carbonated solution acts as an ionized water to neutralize the occurrence of static electricity, for preventing the surface of the wafer W from taking an electrical charge.

However, since the transporting passage 101 and the jet pump 103 are both made of metal, such as stainless steel, the flowing of the carbonated solution as a weak acid into the transporting passage 101 and the jet pump 103 causes metallic components (e.g. iron, chromium, nickel, etc.) to dissolve into the carbonated solution at the rate of e.g. 0.1–0.5 ppb. If the carbonated solution containing such metallic components is supplied to the surface of the wafer W through the jet nozzle 100, the wafer W will be contaminated with the components.

SUMMARY OF THE INVENTION

Accordingly, it is therefore an object of the present invention to provide a processing apparatus and a processing method, by which it is possible to prevent the substrate to be contaminated with metallic components in supplying the pressurized treatment liquid to the substrate.

According to the first aspect of the invention, the object of the present invention described above can be accomplished by a processing apparatus which includes: a first nozzle for supplying a treatment liquid for applying a designated process on a substrate; a first liquid passage connected to the first nozzle, for transporting the treatment liquid to the first nozzle; a pressurizing mechanism for pressurizing the treatment liquid thereby to feed it to the first liquid passage; a second nozzle for supplying a charge removing liquid to the substrate; and a second liquid passage arranged independently of the first liquid passage and connected to the second nozzle, for transporting the charge removing liquid to the second nozzle.

According to the present invention, since the charge removing liquid is supplied to the substrate via a different route from that for the treatment liquid, the charge removing liquid does not come in contact with the pressurizing mechanism. Therefore, it is possible to prevent metallic components of constituents of the pressuring mechanism from dissolving into the charge removing liquid, preventing the contamination on the substrate.

It is preferable that the second nozzle and the second liquid passage are both made of material which does not dissolve metallic components thereof into the charge removing liquid in spite of the contact of the second nozzle and the second liquid passage with the charge removing liquid.

The second nozzle may supply the charge removing liquid in the form of mist. By connecting a gas passage for supplying gas from a gas source to the second nozzle and mixing the gas with the charge removing liquid passing through the second nozzle, the charge removing liquid can be ejected in the form of mist. Consequently, it is possible to reduce the thickness of a liquid film of the charge removing liquid formed on the substrate, preventing the reduction in processing effect of the treatment liquid.

The charge removing liquid may be identical with a carbonated solution. The carbonated solution can be produced by a dissolving device for dissolving carbon dioxide in a pure water. In this case, the gas to be supplied to the second nozzle may be either carbon dioxide or nitrogen gas.

The dissolving device may include a cell unit into which the pure water is supplied and a hollow thread which is disposed in the cell unit and into which carbon dioxide is supplied. Then, the so-constructed dissolving device is simple in constitution and facilitates its maintenance.

Preferably, the charge removing liquid is fed to the second nozzle by pneumatics without the intermediary of a mechanical pressurizing mechanism, such as a pump. With the arrangement, it is possible to reduce the possibility of the substrate being contaminated in metal.

According to the second aspect of the invention, there is also provided a processing method for a substrate which includes: a first step of supplying a charge removing liquid to the substrate thereby forming a liquid film thereon; and a second step of supplying a pressurized treatment liquid to the substrate having the liquid film of the charge removing liquid formed on the substrate.

In the above method, preferably, the first step is continuously carried out while the second step is carried out. Further, it is also preferable that the charge removing liquid and the treatment liquid are supplied to the substrate through the intermediary of two different liquid passages. In the first step of the above method, preferably, the charge removing liquid in the form of mist is ejected to the substrate. The charge removing liquid may be identical to a carbonated solution.

According to the third aspect of the invention, there is also provided a processing method for a substrate which includes: a step of supplying a charge removing liquid to the substrate thereby forming a liquid film thereon; and a step of supplying a pressurized treatment liquid to the substrate having the liquid film of the charge removing liquid formed on the substrate;

The above and other features and advantages of this invention will become apparent, and the invention itself will best be understood, from a study of the following description and appended claims, with reference had to the attached drawings showing a preferred embodiment of the invention.

DESCRIPTION OF THE PREFERRED EMBODIMENTS

Figure 1:
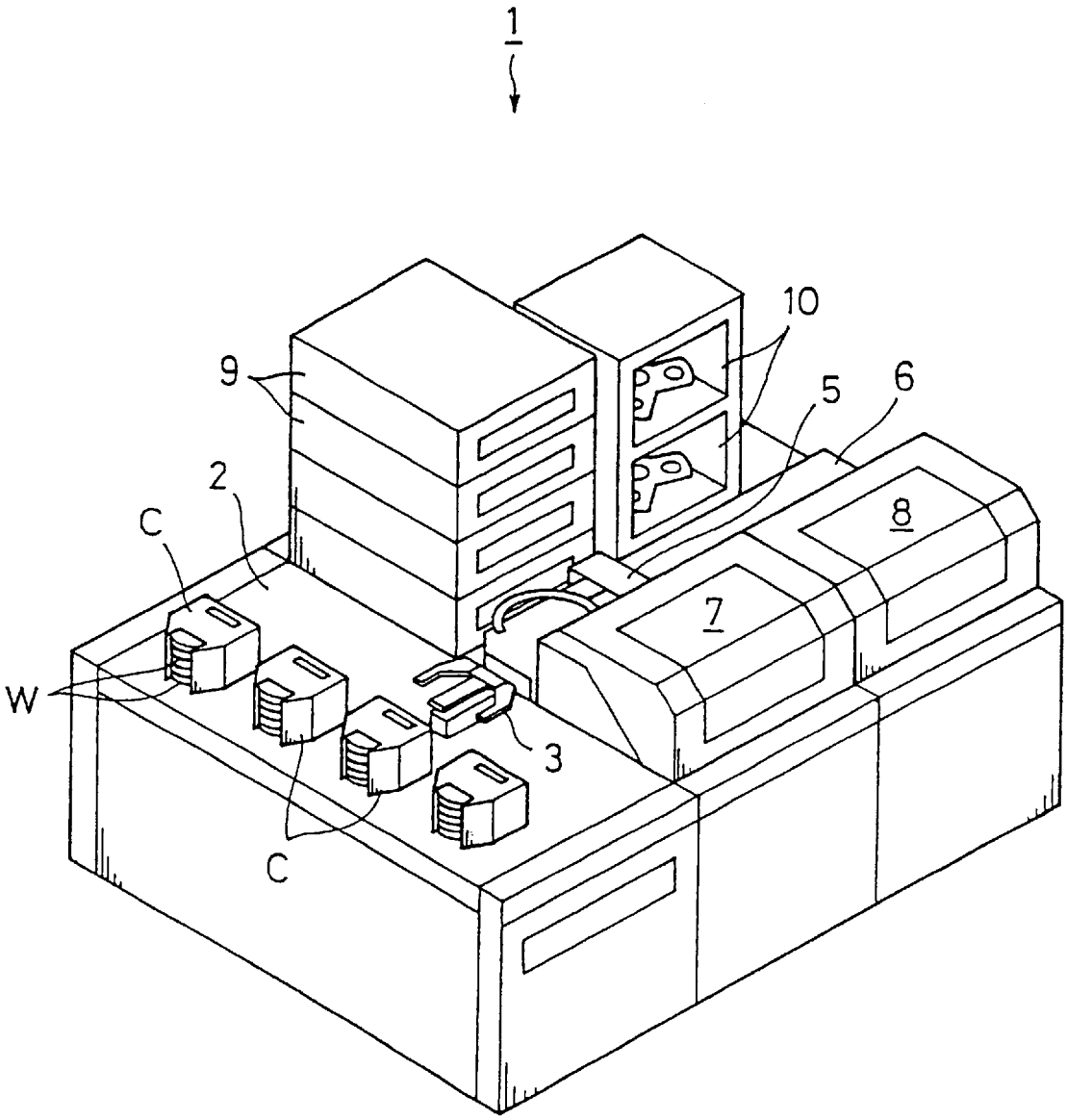
FIG. 1 is a perspective view of a cleaning system equipped with a surface cleaning apparatus in accordance with the present invention.

Preferred embodiments of the present invention will be described by an example of a cleaning system which is constructed so as to transport the wafers as the substrates in carriers, clean and dry the wafers one by one, and discharge them in carriers. FIG. 1 is a perspective view of the cleaning system 1 for explanation of the embodiment of the invention.

The cleaning system 1 is provided with a mount section 2 which can mount four carriers C each accommodating the wafers W therein. Arranged at the center of the cleaning system 1 is an arm 3 which picks the uncleaned (before cleaning) wafers W one by one from the carrier C mounted on the mount section 2 and also accommodates the cleaned wafer W in the carrier C. On the back of the arm 3, a transfer arm 5 is standing ready to convey the wafer W to and from the arm 3.

The transfer arm 5 can move along a transfer path 6 in the middle of the cleaning system 1. Various processing apparatuses are disposed on both sides of the transfer path 6. In detail, a front face cleaning apparatus 7 for cleaning the front face of the wafer W and a back face cleaning apparatus 8 for cleaning the back face of the wafer W are juxtaposed on one side of the transfer path 6. While, on the other side of the transfer path 6, four heating devices 9 are stacked up to heat the wafers W for dry. Adjacent to the heating devices 9, two wafer turn-over devices 10 are also stacked up.

Figure 2:
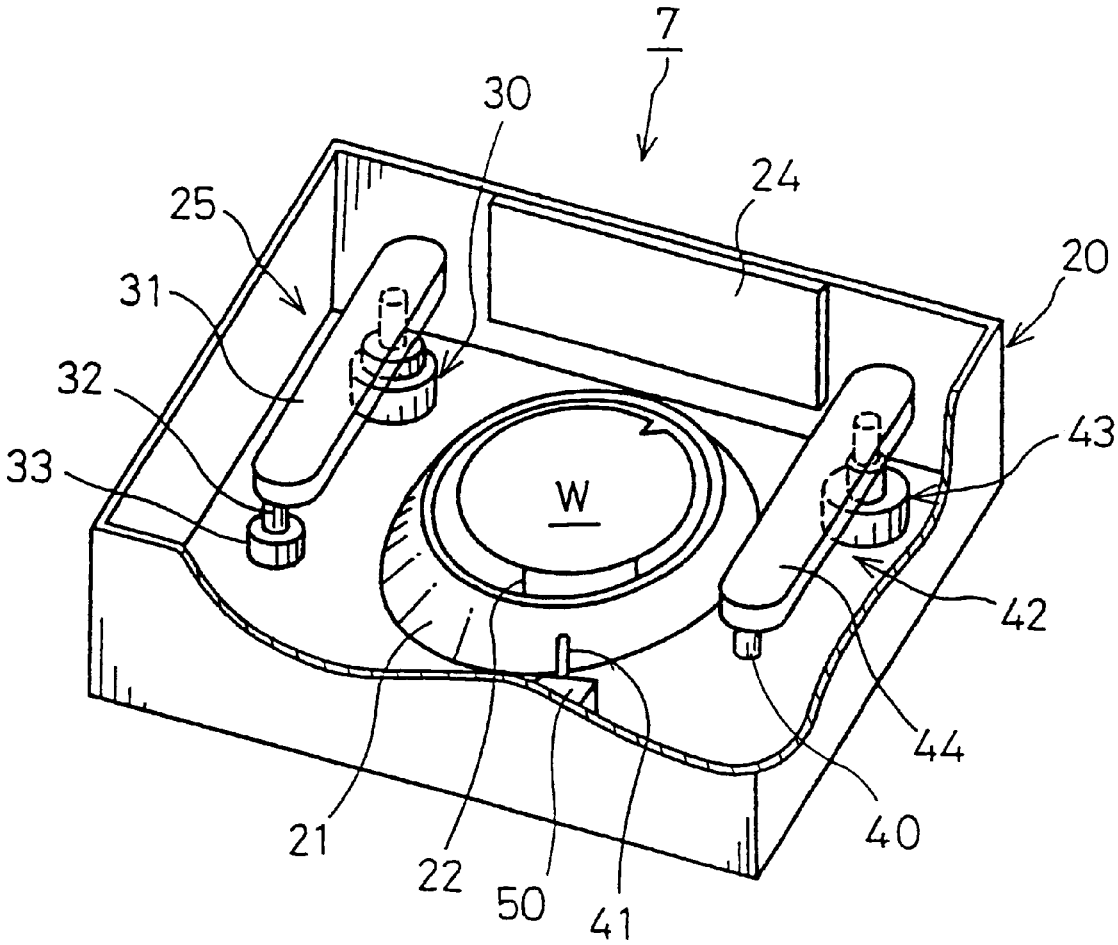
FIG. 2 is a perspective view of the surface cleaning apparatus of FIG. 1.
Figure 3:
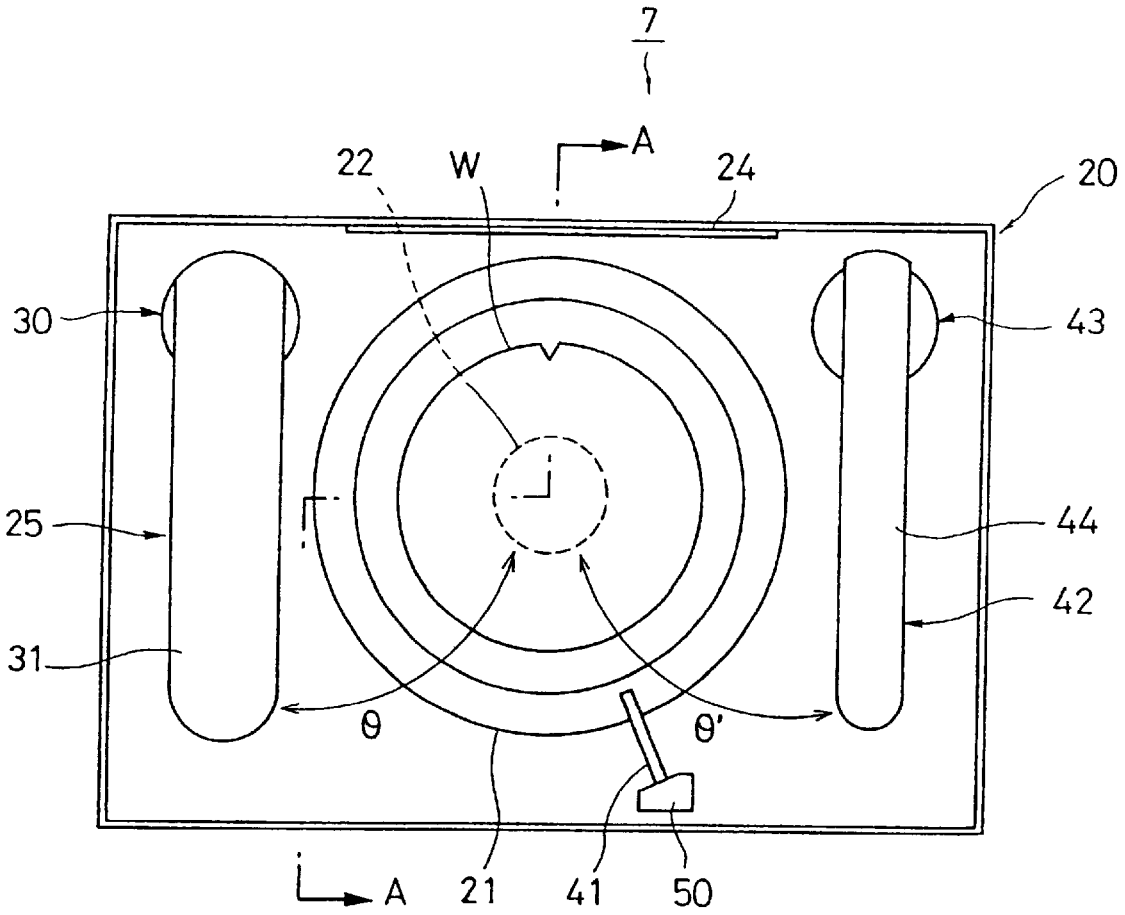
FIG. 3 is a plan view of the surface cleaning apparatus of FIG. 2.
Figure 4:
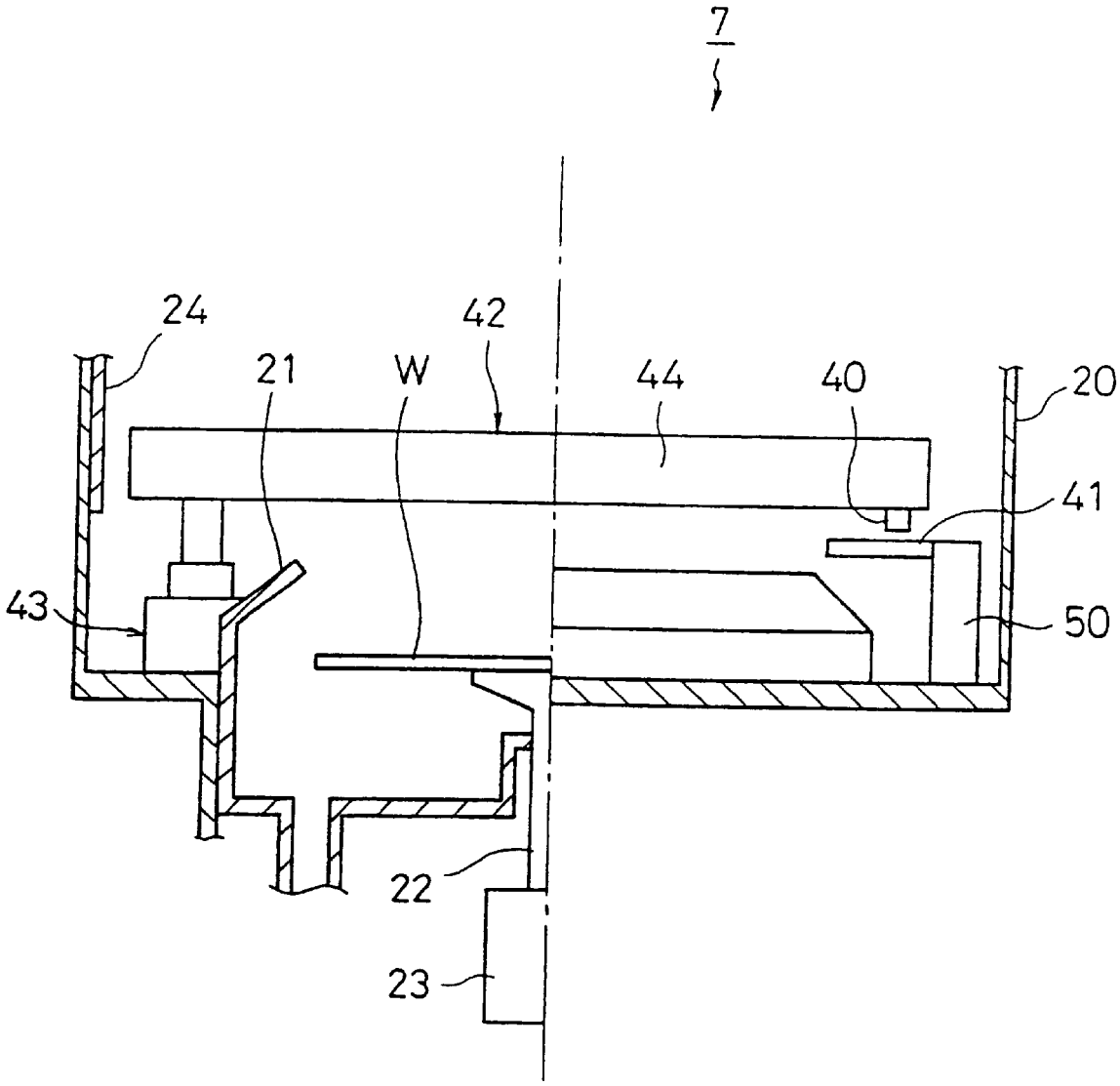
FIG. 4 is a sectional view taken along a line A—A of FIG. 3.

Next, referring to FIGS. 2 to 4, we describe the structure of the front face cleaning apparatus 7.

The front face cleaning apparatus 7 has a casing 20. The casing 20 is provided, at a substantial center thereof, with a cup 21. In the cup 21, a spin chuck 22, on which the wafer W is sucked horizontally, is arranged. The spin chuck 22 is rotated by a motor 23 disposed under the cup 21. During the cleaning process, the pure wafer (DIW) is supplied to the surface of the wafer W rotated by the spin chuck 22. The cup 21 encircling the wafer W serves to prevent the pure water from dispersing to the circumference. Provided on the wall of the casing 20 is a door 24 which moves up and down at the time of getting the wafer W in and out.

Further, the front face cleaning apparatus 7 is provided with a scrub cleaning machine 25. The scrub cleaning machine 25 has an arm member 31 supported on an upper end of a driving mechanism 30 horizontally. The driving mechanism 20 allows the arm member 31 to move up and down and also turn in a direction θ of FIG. 3. Below a tip of the arm member 31, a shaft 32 is arranged so as to elevate and rotate by an elevating and rotating mechanism (not shown). A processor i.e., a scrubber 33 is fixed on a lower end of the shaft 32.

The processor 33 has a member consisting of a brush, a sponge, etc. attached on the lower face. By rotating the processor 33 and contacting it with the wafer W, it is possible to carry out the cleaning process of the surface of the wafer W. Note, upon connecting a "pure water" supply passage with the processor 33, the cleaning process may be carried out by contacting the processor 33 with the surface of the wafer W while ejecting the pure water through the lower center of the processor 33.

The front face cleaning apparatus 7 further includes a jet nozzle 40 for ejecting the highly pressurized pure water to the wafer W. In the casing 20, the jet nozzle 40 is installed in a jet cleaning machine 42 positioned in symmetry with the scrub cleaning machine 25 over the spin chuck 22. The jet cleaning machine 42 has an arm member 44 supported on an upper end of a driving mechanism 43 horizontally. The driving mechanism 43 allows the arm member 44 to move up and down. Also, the driving mechanism 43 is capable of turning in a direction θ' of FIG. 3 thereby to reciprocate the jet nozzle 40 mounted on a tip of the arm member 44, above the wafer W.

Figure 5:
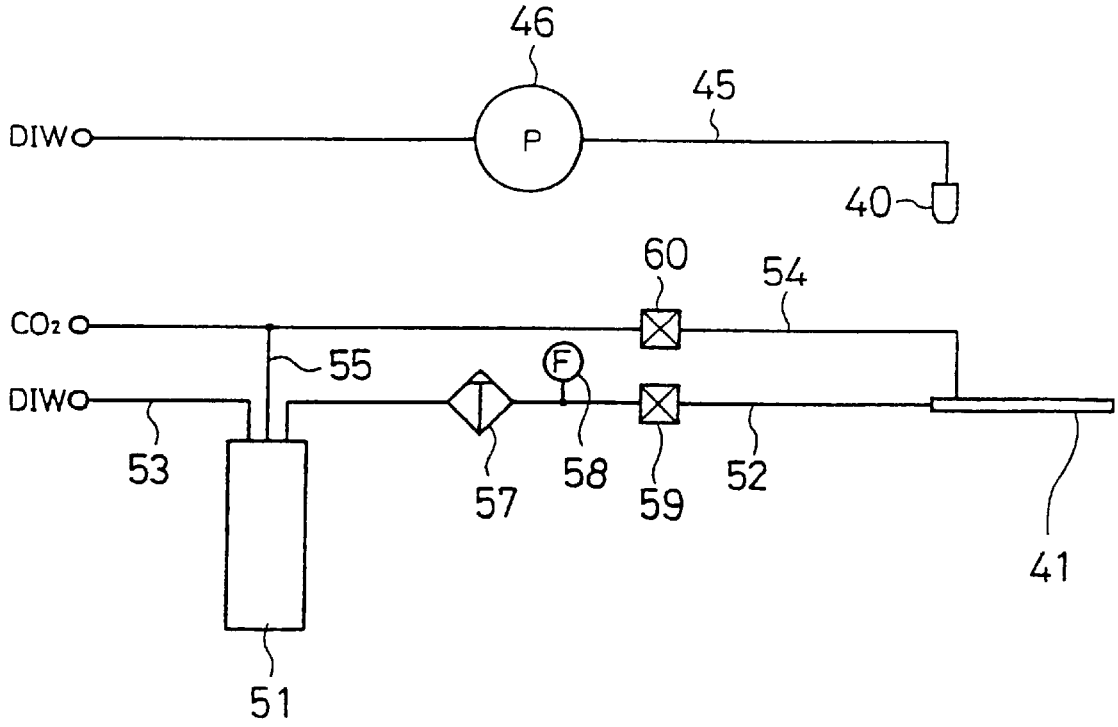
FIG. 5 is a view showing a supply system of liquid for a jet nozzle and a spray nozzle.

Further, as shown in FIG. 5, the jet nozzle 40 is connected to a "pure water" supply passage 45 in which a jet pump 46 is interposed. Owing to the using of drive air, the jet pump 46 in the form of so-called plunger pump applies pressure to the pure water to be the high pressure water.

As shown in FIGS. 2 to 4, the front face cleaning apparatus 7 further includes a spray nozzle 41 for supplying the carbonated solution to the wafer W. The spray nozzle 41 is attached to a cradle 50 and orientated so as to exhale the carbonated solution toward the center of the wafer W.

Again, as shown in FIG. 5, a cell unit 51 is connected to the spray nozzle 41 through a transporting passage 52. The cell unit 51 allows carbon dioxide ($CO_2$) to dissolve in the pure water to produce the carbonated solution. The transporting passage 52 is made of material undissolving metallic components (e.g. iron, chromium, nickel, etc.) into the carbonated solution, for example, fluororesin.

Figure 6:
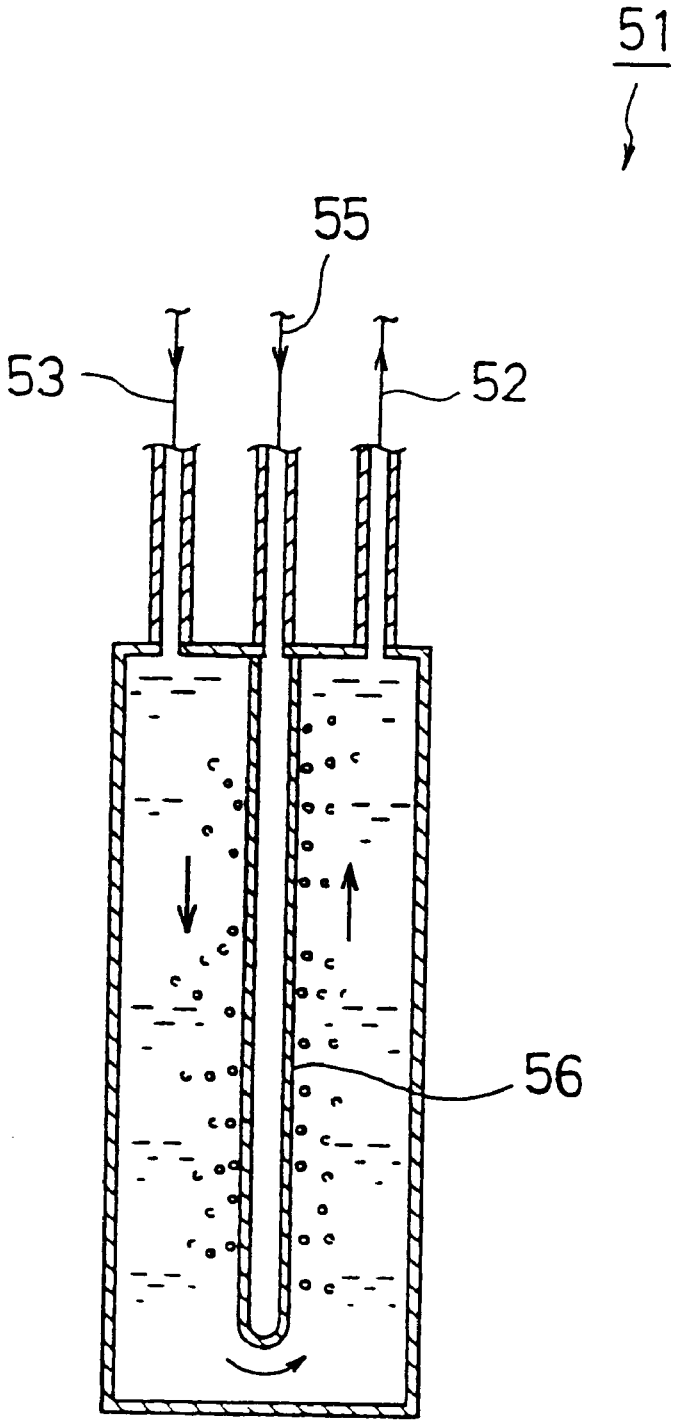
FIG. 6 is a sectional view showing the interior of a cell unit of FIG. 5.

As shown in FIG. 6, connected to the cell unit 51 are an outlet of a "pure water" supply passage 53, an outlet of a branch passage 55 which is branched from the partway of a "carbon dioxide" supply passage 54 for supplying carbon dioxide, and an inlet of the transporting passage 52.

In the cell unit 51, a hollow thread 56 is arranged to communicate with the branch passage 55. The pure water flowing into the cell unit 51 via the "pure water" supply passage 53 by-passes the circumference of the hollow thread 56 and sequentially flows out toward the transporting passage 52. In the meantime, carbon dioxide is discharged from the hollow thread 56 into the pure water in the cell unit 51, so that the carbonated solution saturated on the order of e.g. 0.05 Mω in resistivity is produced. The so-constructed cell unit 51 can be made at low cost and almost never requires a labor of maintenance.

In the partway of the transporting passage 51, there are provided a cleaning filter 57, a flow meter 58 for confirmation of the flow rate, and a valve 59, in order. The opening of the valve 59 causes the carbonated solution to be fed to the spray nozzle 41.

The transportation of carbonated solution for the nozzle 41 is attained by utilizing a factory pressure (it means pressurized air being supplied to various sections in the factory, on the order of 0.5 to 1 kgf/cm$^2$ in pressure). Therefore, the jet pump 46 of metal, such as stainless steel, is not employed in this "carbonated solution" supply system, which is different from the "pure water" supply system. In addition, not only the transporting passage 52 but all of the cleaning filter 57, the flow meter 58 and the valve 59 are made of material undissolving metallic components into the carbonated solution, for example, fluororesin, quartz, or the like. Accordingly, while transporting the carbonated solution from the cell unit 51 to the spray nozzle 41, there is no possibility that the metallic components dissolve into the carbonated solution.

Figure 7:
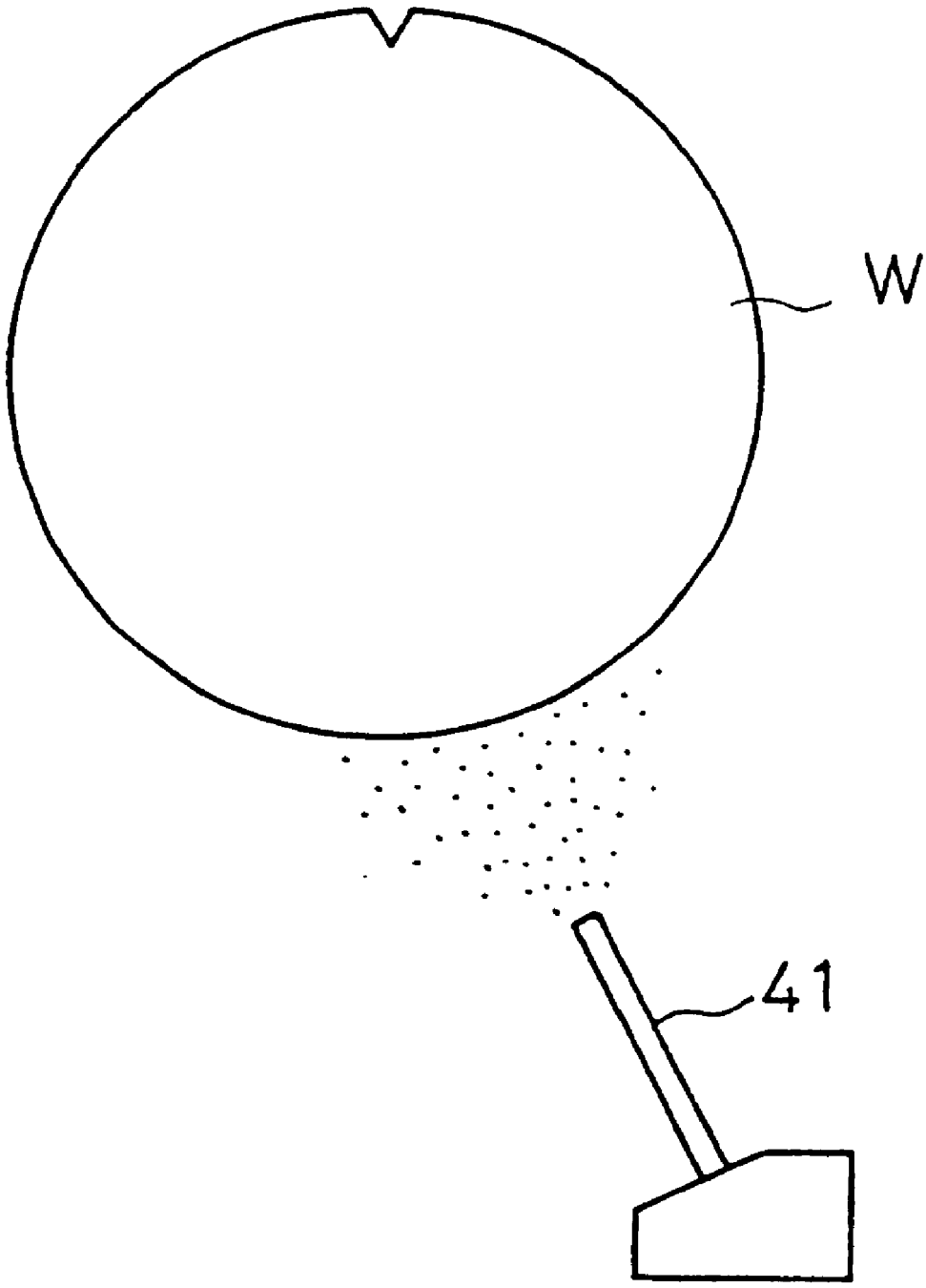
FIG. 7 is an explanatory view showing a condition to supply the carbonated solution in mist to the wafer surface through the spray nozzle.

The spray nozzle 41 is also made of material undissolving metallic components into the carbonated solution, for example, quartz. Further, the spray nozzle 41 is connected to the "carbon dioxide" supply passage 54. Additionally, another valve 60 is arranged in the partway of the "carbon dioxide" supply passage 54. When opening this valve 60, carbon dioxide is supplied into the nozzle 41. Then, carbon dioxide supplied into the nozzle 41 is supplied in the carbonated solution flowing in the nozzle 41. Consequently, as shown in FIG. 7, the carbonated solution in the form of mist is ejected through the nozzle 41 and supplied to the surface of wafer W.

The ejection of liquid through the jet nozzle 40 and the spray nozzle 41 can be controlled in accordance with the process recipe freely. Therefore, the above-mentioned cleaning system is capable of the following operations of:

(1) supplying the carbonated solution in the form of mist to the surface of the wafer W through the spray nozzle 41 before supplying the pure water to the surface of the wafer W through the jet nozzle 40;

(2) supplying the carbonated solution in the form of mist to the surface of the wafer W through the spray nozzle 41 at the same time of supplying the pure water to the surface of the wafer W through the jet nozzle 40;

(3) only supplying the pure water to the surface of the wafer W through the jet nozzle 40 while stopping the supply of carbonated solution in the form of mist to the surface of the wafer W through the spray nozzle 41; and so on.

Next, we describe the cleaning process of the wafer W. First of all, by a not-shown transfer robot, the carrier C having the uncleaned wafers W (e.g. 25 pcs.) accommodated therein is mounted on the mount section 2. Then, the wafer W is taken out of the carrier C mounted on the mount section 2 and delivered to the transfer arm 4 through the arm 3. Next, by using the front surface cleaning apparatus 7 and the back surface cleaning apparatus 8, the wafer W is washed to remove the particles etc. adhering to both faces of the wafer W.

Figure 8:
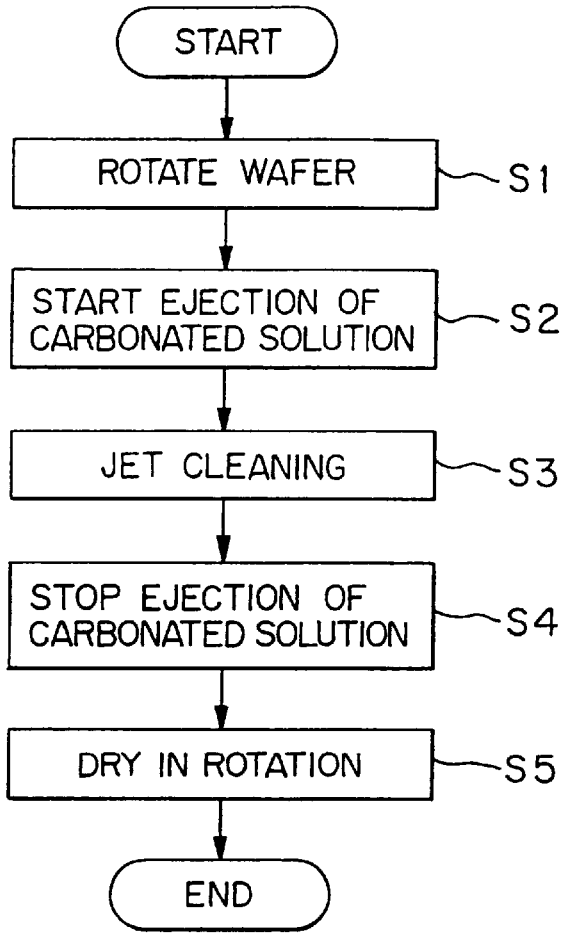
FIG. 8 is a flow chart for explanation of the cleaning method of the invention.

Here, we now describe the cleaning process executed in the front face cleaning apparatus 7. The front face cleaning apparatus 7 can execute the jet cleaning and the scrub cleaning individually, the scrub cleaning after the jet cleaning, and vice versa. Nevertheless, the cleaning process in order to execute the jet cleaning after the scrub cleaning will be described with reference to the flow chart of FIG. 8, hereinafter.

First, the transfer arm 5 enters into the front face cleaning apparatus 7 through the door 24 and delivers the wafer W to the spin chuck 22 as shown in FIG. 3. Next, the transfer arm 5 withdraws from the front face cleaning apparatus 7 and subsequently, the door 24 is closed. Thereafter, it is executed to rotate the wafer W sucked on the spin chuck 22, integrally. That is, it is the beginning of cleaning process (step S1). First, it is carried out to move the scrub cleaning machine 25 above the wafer W and subsequently contact the processor 30 with the surface of the wafer W in the scrub cleaning. After completing the scrub cleaning, the jet cleaning machine 41 is driven to execute the jet cleaning.

As shown in FIGS. 5 and 6, it is executed to supply the pure water (DIW) into the cell unit 51 for dissolving carbon dioxide ($CO_2$) in the pure water, thereby producing the carbonated solution ($H_2CO_3$) saturated on the order of e.g. 0.05 Mω in resistivity. Note, since the cell unit 51 having the hollow thread 56 is simple in construction, the unit 51 can be provided at a low cost in comparison with the conventional bubbling part 102 for keeping the resistivity of 0.2 Mω, while almost abolishing the maintenance.

The carbonated solution is transported to the spray nozzle 41 through the transporting passage 52 owing to the pneumatic pressure to be supplied for the factory, on one hand. On the other hand, carbon dioxide is supplied to the nozzle 41 through the "carbon dioxide" supply passage 54, as well. In this way, the carbonated solution is brought into mist in the nozzle 41. The carbonated solution in the form of mist is then ejected toward the surface of the wafer W, so that the liquid film of the carbonated solution is formed on the surface of wafer W (step S2).

Next, it is executed to swivel the jet cleaning machine 42 in the stand-by state to the upside of the wafer W and further supply the pure-water being pressurized up to high pressure of e.g. 50 to 100 kgf/cm$^2$ by the jet pump 46, to the surface of the wafer W through the jet nozzle 40 (step S3). On reciprocating the jet cleaning machine 42 at least between the surface center of the wafer W and the wafer periphery, the highly pressurized pure water is supplied to the whole surface of the wafer W uniformly, in accordance with the rotation of the wafer W.

In this way, on the individual provision of the jet nozzle 40 and the spray nozzle 41, it is executed to supply the carbonated solution in mist to the wafer W through the spray nozzle 41 thereby preventing the wafer W from being electrically charged owing to the formation of the liquid film of the carbonated solution on the wafer surface, and subsequently supply the pure water under high pressure to the wafer W through the jet nozzle 40 to remove the impurities, such as particles, from the wafer surface.

In this case, since the supply passage of the carbonated solution is provided with no mechanical pump, such as the jet pump 46, there is no possibility that the metallic components of the pump 46 dissolve into the carbonated solution. Furthermore, the transporting passage 52 is made of fluororesin, the spray nozzle 41 of quartz, resin, etc., and the other elements, i.e., the filter 57, the flow meter 58 and the valve 59 are made of materials which do not dissolve the metallic components in the carbonated solution. Therefore, it is possible to supply the carbonated solution having no metallic components to the wafer W, thereby preventing the metallic contamination on the wafer W. Accordingly, while preventing the electrostatic destroy against the devices on the wafer W, the wafer surface can be cleaned appropriately.

Additionally, the supply of "misty" carbonated solution prior to the supply of highly pressurized water allows the liquid film of the carbonated solution to be formed on the wafer surface, whereby the film thickness of carbonated solution can be thinned remarkably. Then, it is possible to prevent the wafer W from being charged electrically with no influence on the pure water's cleaning effect against the wafer W.

Moreover, even if the misty carbonated solution is mixed with the pure water supplied through the jet nozzle 40, there is no reduction in cleaning effect due to the lowered cleaning capability of the pure water. Thus, it is possible to maximize the cleaning effect coming from the highly pressurized pure water.

Figure 9:
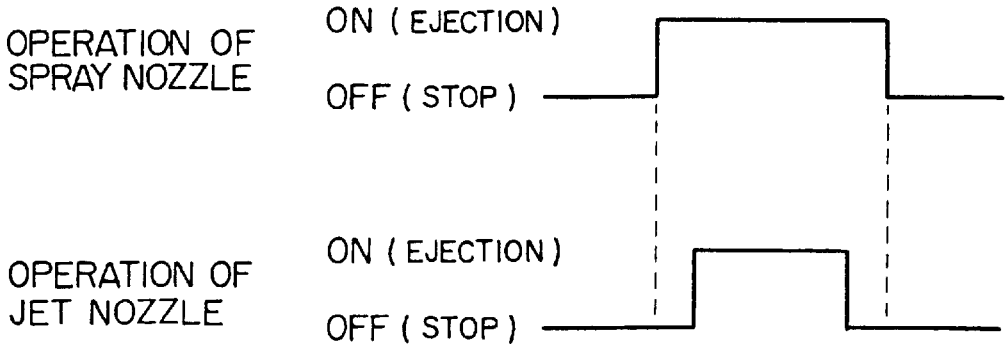
FIG. 9 is a timing chart showing an injection timing of the liquid through the spray nozzle and the jet nozzle.

After a designated period has passed, it is executed to stop the supply of pure water from the jet cleaning machine 42, so that it is brought into the original stand-by state. Subsequently, in a short time, it is executed to stop the ejection of misty carbonated solution through the spray nozzle 41 (step S4). Thereafter, the wafer W is rotated at high speed in the drying process (step S5), so that the cleaning process is completed. The above-mentioned operations of the spray nozzle 41 and the jet nozzle 40 are shown in the timing chart of FIG. 9.

When the cleaning process of the wafer W is completed, then the door 24 is opened and the wafer W is taken out of the front face cleaning apparatus 7 by the transporting arm 5. Thereafter, being turned over by the wafer turn-over devices 10, the back face of the wafer W is washed and dried by the back face cleaning apparatus 8. In accordance with the situation, the wafer W is further dried by the drying device 9 for e.g. 30 seconds at 100° C. After completing the designated cleaning process, the wafer W is delivered from the transfer arm 5 to the pick-up arm 3 and accommodated in the carrier C again. Thereafter, the above-mentioned cleaning process is applied on the remaining 24 pieces of wafers W one by one. After the designated cleaning for 25 pcs. wafers has been ended, the carrier C in block is withdrawn out of the cleaning system 1.

In this way, since the front face cleaning apparatus 7 of this embodiment is constructed so as to separately supply the highly pressurized pure water and the carbonated solution on the individual arrangement of the jet nozzle 40 and the spray nozzle 41, it is possible to supply the carbonated solution having no metallic components to the surface of the wafer W, preventing the metallic contamination on the wafer W. Accordingly, while preventing the electrostatic destroy against the devices on the wafer W, the wafer surface can be cleaned appropriately.

Figure 10:
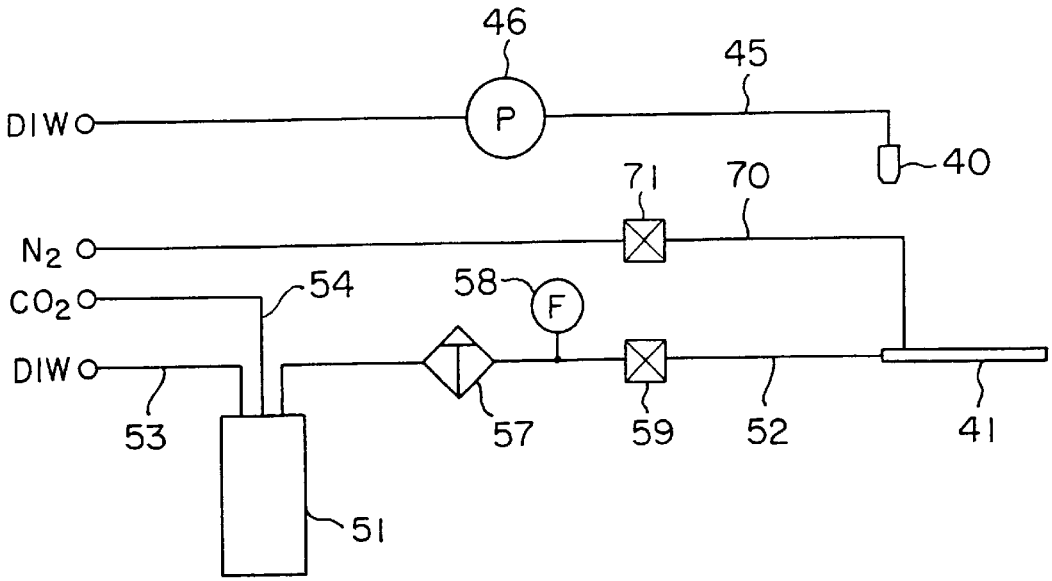
FIG. 10 is a view showing another supply system of liquid for the jet nozzle and the spray nozzle.

Note, the present invention is not limited to the above-mentioned embodiment and may be embodied in various forms. For example, as shown in FIG. 10, upon connecting the "carbon dioxide" supply passage 54 to the cell unit 51 only, there may be additionally provided a "$N_2$" supply passage 70 which supplies nitrogen gas ($N_2$) for producing the misty carbonated solution and which is connected to the spray nozzle 41. In this case, it is executed to open a valve 71 interposed in the "$N_2$" supply passage 70 and supply $N_2$ gas to the spray nozzle 41, thereby making the carbonated solution in the form of mist by $N_2$ gas. Note, the structure of the embodiment of FIG. 10 is identical to that of the front face cleaning apparatus 7 of FIGS. 2 to 5, except of providing the "$N_2$" supply passage 70 and also connecting the outlet of the "carbon dioxides" supply passage 54 only to the cell unit 51. According to the embodiment of FIG. 10, it is possible to reduce the consumption of expensive carbon dioxide thereby saving the running cost of the cleaning apparatus.

Alternatively, the carbonated solution may be supplied to the wafer W simultaneously with supplying the pure water to the wafer W through the jet nozzle 40. Also in this method, it is possible to remove the impurities, such as particles, from the wafer W while preventing the electrostatic destroy against the devices on the wafer W. Further, the spray nozzle 41 may be installed in the jet cleaning machine 42. Consequently, it would be possible to move the spray nozzle 41 in reciprocation above the wafer W, which is similar to the jet nozzle 40.

It is noted there is a problem that carbon dioxide may rough the wafer surface in accordance with the situations of the wafer surface and the sorts of cleaning process. In such a case, the only pure water highly pressurized through the jet nozzle 40 may be supplied to the surface of the wafer W while stopping the supply through the spray nozzle 41. In the prior art, since the only carbonated solution is supplied to the wafer W by the single supply means, it is possible to solve the above-mentioned problem. On the contrary, the cleaning apparatus of this embodiment is capable of solving the problem owing to the individual provision of the jet nozzle 40 and the spray nozzle 41. In this way, the selective adoption between a case of only supplying the pure water and another case of supplying both pure water and carbonated solution allows the cleaning process to be broadened in its applications.

Note, in case of a small flow rate of the carbonated solution supplied from the spray nozzle 41, the carbonated solution may be supplied to the wafer W without supplying the gas (carbon dioxide or nitrogen gas) to the spray nozzle 41. Then, without being connected to the spray nozzle 41, the "carbon dioxide" supply passage 54 may be connected to the cell unit 51 only.

Figure 11:
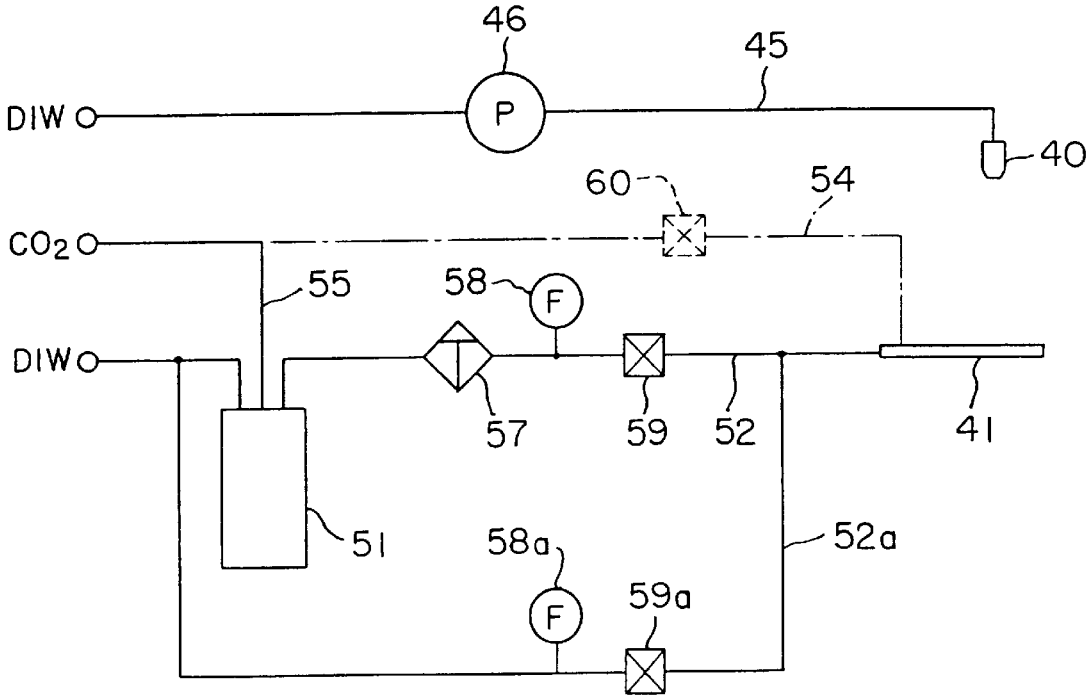
FIG. 11 is a view showing another supply system of liquid for the jet nozzle and the spray nozzle.
Figure 12:
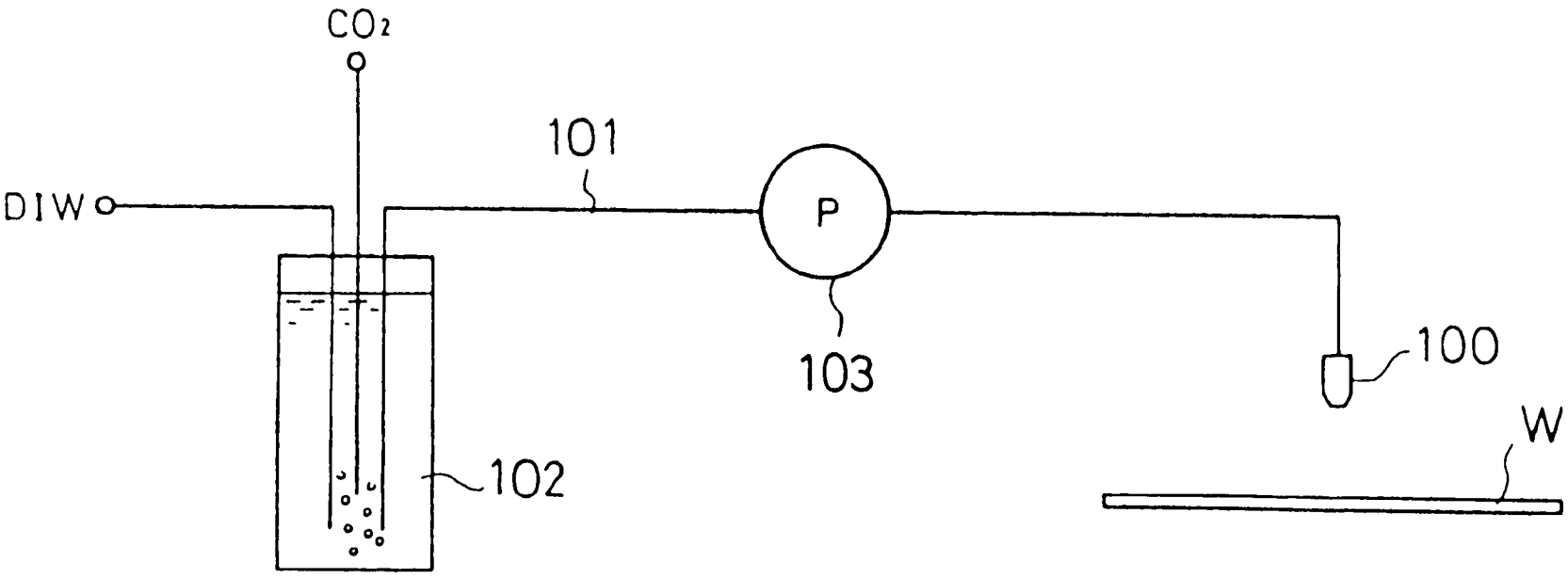
FIG. 12 PRIOR ART
FIG. 12 is a view showing the conventional supply system for the jet nozzle.

Additionally, as shown in FIG. 11, there may be provided a "pure water" supply passage 52*a* which is connected to the transporting passage 52 in front of the nozzle 41. Then, the "pure water" supply passage 52*a* is provided, therein, with a flow meter 58*a* and a valve 59*a*. Thus, owing to the switching in operation between the valve 59 and the valve 59*a*, it is possible to appropriately supply any of the pure water, the saturated carbonated solution and the mix of pure water and saturated carbonated solution as occasion demands. With such an arrangement, it is possible to attain an effect to remove the electrical charge as occasion demand, during not only the jet cleaning but the scrub cleaning. Note, in the modification, the valves 59, 59*a* may be replaced with a mixing valve positioned at a junction between the transporting passage 52 and the "pure water" supply passage 52*a*. In connection, the "carbon dioxide" supply passage 54 may be either connected or disconnected to the nozzle 41 (see a broken line in FIG. 11).

Although the substrates to be cleaned are identical to the wafers W in the above descriptions, they may be replace with LCD substrates in the modification. Further, if paying attention to the effect of the invention, that is, its performance of appropriate treatment on the substrates while preventing the electrostatic destroy, then the present invention is applicable to any apparatus or method of applying a designated treatment liquid on the substrates without being limited to the cleaning process.

What is claimed is:

1. A processing apparatus comprising:

a first nozzle for supplying a treatment liquid for applying a designated process on a substrate;

a first liquid passage connected to the first nozzle, for transporting the treatment liquid to the first nozzle;

a pressurizing mechanism for pressurizing the treatment liquid thereby to feed it to the first liquid passage;

a second nozzle for supplying a charge removing liquid to the substrate; and a second liquid passage arranged independently of the first liquid passage and connected to the second nozzle, for transporting the charge removing liquid to the second nozzle;

wherein the second nozzle and the second liquid passage are both made from a material which will not dissolve even though the charge removing liquid dissolves metallic components and the charge removing liquid comes into contact with the second nozzle and the second liquid passage.

2. The processing apparatus as claimed in claim 1, wherein the second nozzle is adapted so as to supply the charge removing liquid in a form of mist.

3. The processing apparatus as claimed in claim 2, further comprising a gas passage for supplying gas from a gas source to the second nozzle, wherein the gas is mixed with the charge removing liquid, whereby the charge removing liquid in the form of mist is ejected through the second nozzle.

4. The processing apparatus as claimed in claim 3, further comprising a dissolving device which dissolves carbon dioxide into pure water thereby to produce a carbonated solution as the charge removing liquid, wherein the gas is identical to carbon dioxide.

5. A processing apparatus as claimed in claim 1, wherein the charge removing liquid is a carbonated solution.

6. A processing apparatus comprising:

a first nozzle for supplying a treatment liquid for applying a designated process on a substrate;

a first liquid passage connected to the first nozzle, for transporting the treatment liquid to the first nozzle;

a pressurizing mechanism for pressurizing the treatment liquid thereby to feed it to the first liquid passage;

a second nozzle for supplying a charge removing liquid to the substrate, wherein the charge removing liquid is a carbonated solution;

a second liquid passage arranged independently of the first liquid passage and connected to the second nozzle, for transporting the charge removing liquid to the second nozzle; and a dissolving device which dissolves carbon dioxide into pure water thereby to produce a carbonated solution, wherein the dissolving device includes:

a cell unit into which the pure water is supplied; and a hollow thread which is disposed in the cell unit and into which the carbon dioxide is supplied;

wherein the carbon dioxide supplied into the hollow thread is discharged into the pure water, whereby the carbonated solution is produced.

7. The processing apparatus as claimed in claim 1, wherein the charge removing liquid is fed to the second nozzle by pneumatics.

8. The processing apparatus according to claim 6, wherein the second nozzle is adapted so as to supply the charge removing liquid in a form of mist.

9. The processing apparatus according to claim 8, further comprising a gas passage for supplying gas from a gas source to the second nozzle, wherein the gas is mixed with the charge removing liquid, whereby the charge removing liquid in the form of mist is ejected through the second nozzle.

10. The processing apparatus according to claim 9, wherein the gas is identical to carbon dioxide.

11. The processing apparatus according to claim 6, wherein the charge removing liquid is fed to the second nozzle by pneumatics.

12. A processing apparatus comprising:

a first nozzle for supplying a treatment liquid for applying a designated process on a substrate;

a first liquid passage connected to the first nozzle, for transporting the treatment liquid to the first nozzle;

a pressurizing mechanism for pressurizing the treatment liquid thereby to feed it to the first liquid passage;

a second nozzle for supplying a charge removing liquid to the substrate; and a second liquid passage, connected to the second nozzle, for transporting the charge removing liquid to the second nozzle, wherein said first liquid passage and said second liquid passage are separate and are not connected by a passage.

13. The processing apparatus as claimed in claim 12, wherein:

the treatment liquid is pure water;

the pressurizing mechanism is a jet pump that pressurizes the pure water and directs the pure water into the second liquid passage;

the charge removing liquid is a carbonated solution; and the second nozzle and the second liquid passage are both made from a material that does not dissolve in the carbonated solution upon contact with the carbonated solution.

14. The processing apparatus as claimed in claim 12, wherein the second nozzle is adapted so as to supply the charge removing liquid in a form of mist.

15. The processing apparatus as claimed in claim 14, further comprising a gas passage for supplying gas from a gas source to the second nozzle, wherein the gas is mixed with the charge removing liquid, whereby the charge removing liquid in the form of mist is ejected through the second nozzle.

16. The processing apparatus as claimed in claim 15, further comprising a dissolving device which dissolves carbon dioxide into pure water thereby to produce a carbonated solution as the charge removing liquid, wherein the gas is identical to carbon dioxide.

17. The processing apparatus as claimed in claim 12, wherein the charge removing liquid is a carbonated solution.

18. The processing apparatus as claimed in claim 12, wherein the charge removing liquid is fed to the second nozzle by pneumatics.

* * * * *